United States Patent [19]

Svatek

[11] 3,977,013

[45] Aug. 24, 1976

[54] EVER-READY CAMERA CASE

[75] Inventor: Thomas A. Svatek, Carlisle, Mass.

[73] Assignee: Polaroid Corporation, Cambridge, Mass.

[22] Filed: Sept. 26, 1974

[21] Appl. No.: 509,694

[52] U.S. Cl. ..... 354/75; 150/52 J; 354/194; 354/288

[51] Int. Cl.[2] ..... G03B 29/00

[58] Field of Search ..... 354/194, 75, 187, 288; 150/52 J

[56] References Cited

UNITED STATES PATENTS

| | | | |
|---|---|---|---|
| 588,611 | 8/1897 | Stern | 354/194 |
| 693,768 | 2/1902 | Wiggins | 354/194 |
| 1,513,176 | 10/1924 | Lyde | 150/52 J |
| 1,918,813 | 7/1933 | Kinzy | 150/52 J |

*Primary Examiner*—John Gonzales
*Attorney, Agent, or Firm*—Alfred E. Corrigan

[57] ABSTRACT

A carrying case is disclosed for photographic cameras of the compact collapsible type which may be extended or erected to an operative position without removal of the camera from the case. The case is constructed to safely contain the camera and securely support the same in all positions of camera movement from a compact folded position to a fully erected position and to permit complete operation of the camera during all normal photographic procedures, including the removal and insertion of film cassettes into a film magazine receiving chamber of the camera without the necessity of removing the camera from the case. The case is formed of specially constructed top and bottom case members that are provided with hinged sections and cooperating linkage which are movable with the camera's housing sections during the erection of the camera to its operative position. The top case member is provided with structure for preventing movement of the carrying case toward its operative position when the camera is still in its folded position.

10 Claims, 3 Drawing Figures

EVER-READY CAMERA CASE

CROSS REFERENCE TO RELATED APPLICATIONS

This application is related to the following commonly assigned copending U.S. patent applications, all filed concurrently herewith:

Ser. No. 509,796 entitled CAMERA CARRYING CASE OR SIMILAR ARTICLE and Ser. No. 509,693 entitled EVER-READY CAMERA CASE, both filed in the name of Richard R. Wareham.

BACKGROUND OF THE INVENTION

1. Field of the Invention

This invention is directed to an improved ever-ready carrying case for photographic cameras and in particular to a case for securely retaining and supporting a camera of the compact collapsible type.

2. Description of the Prior Art

Carrying cases which permit a photograph to be taken without removing the camera from the carrying case are well known in the art and are often referred to as ever-ready cases. However, even though it is possible in these prior art instances to take photographs without removing the camera from the carrying case, it is nevertheless generally required that the camera be removed from the carrying case when the film is to be changed. This presents a recognizable disadvantage to the quick, efficient and convenient use of the camera.

Furthermore, the prior art is silent, or at best, has never completely solved the problem of providing a carrying case that will accommodate and adequately support a camera of the compact collapsible self-developing type which may take the form of a foldable camera of the single-lens reflex type which is folded to a slim compact storage configuration when not in use and which may be erected to a fully upright position when it is to be used. This is particularly true when considering a camera of the type disclosed and described in U.S. Pat. No. 3,810,211 by Richard R. Wareham and Richard Paglia entitled Self-Developing Camera System where the camera includes a plurality of housing members which are pivotally coupled to one another for relative movement between the compact collapsed inoperative position and the extended or erected operative position.

SUMMARY OF THE INVENTION

The present invention has as its primary object the provision of an improved carrying case for a collapsible type camera which will adequately support the camera in all conditions, namely from a fully inoperative collapsed position to a fully erected operative position and which will not move toward the erected operative position when the camera is in the collapsed position.

This is accomplished by forming the carrying case of specially constructed top and bottom case portions that are provided with hinged sections and cooperating linkage which permit the parts of the case to move with the camera's pivoted housing sections during the erection of the camera to an operative position and during the return of the sections to a fully collapsed inoperative position. In a preferred embodiment, one of the hinged sections of the carrying case is provided with a rigid plate-like member which is adapted to engage one of the camera housing sections such that the plate-like member of the carrying case cannot move toward the erected operative position unless the housing section moves toward its erected operative position thereby insuring that the compact collapsed camera cannot fall out of a partially erected carrying case.

Other objects of the invention will in part be obvious and will in part appear hereinafter.

The invention accordingly comprises a carrying case possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in conjunction with the accompanying drawings wherein like numerals have been employed in the different figures to denote the same parts and wherein.

DETAILED DESCRIPTION OF THE INVENTION

Figure 1:
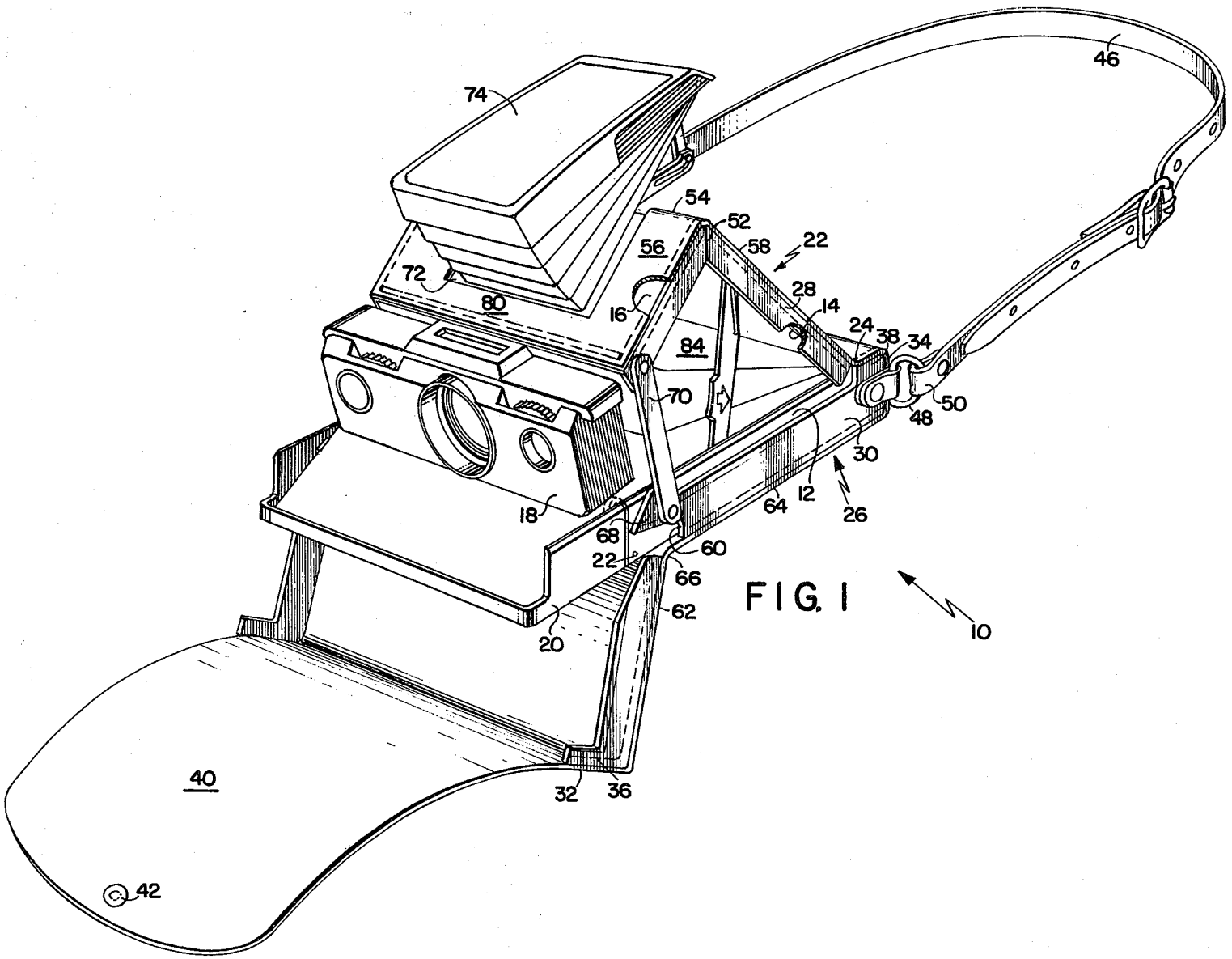
FIG. 1 is a perspective view of the carrying case and camera in the extended or erected operative position that the camera will take for all normal photographic procedures.
Figure 2:
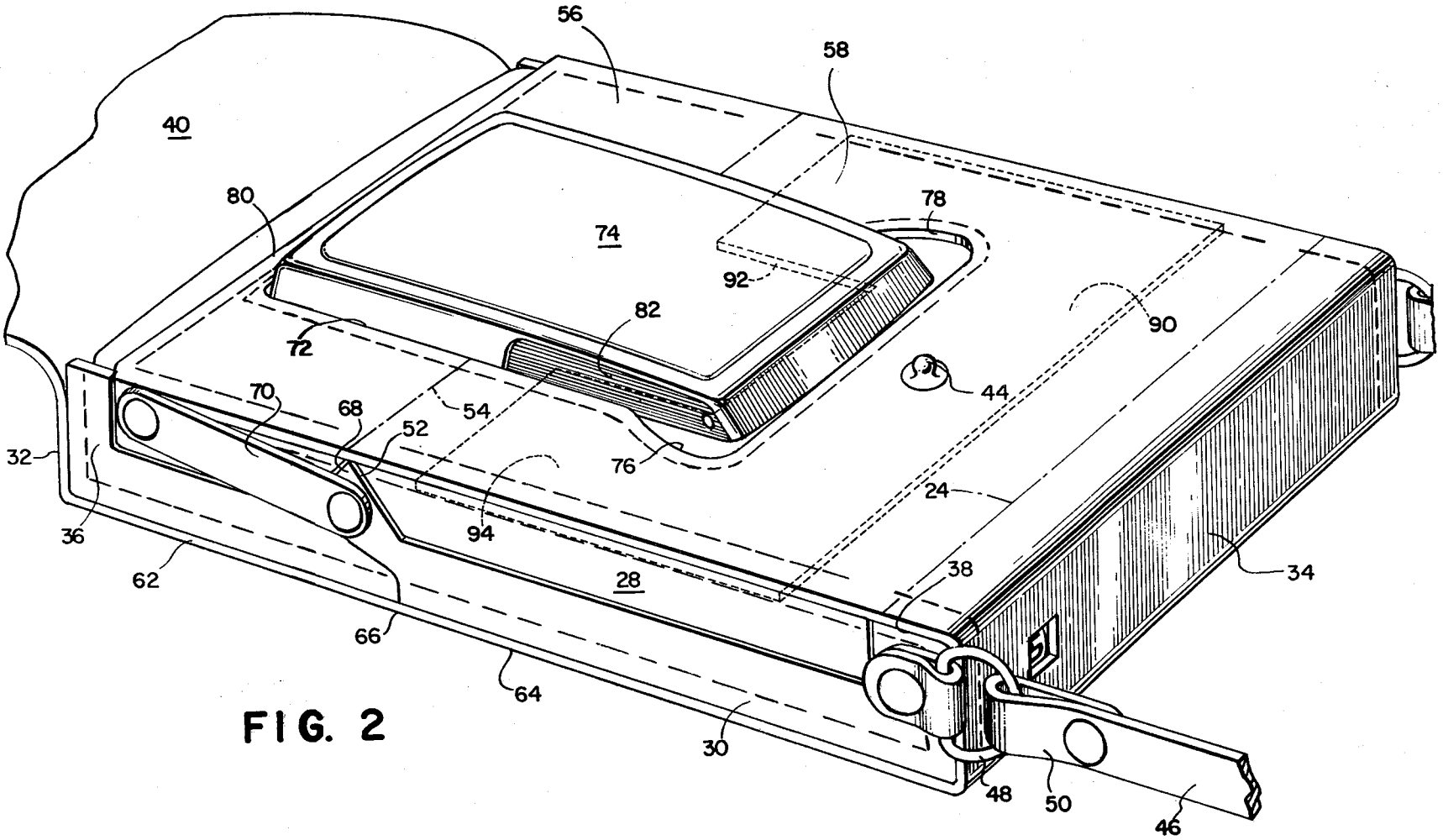
FIG. 2 is an enlarged perspective view of the carrying case of the present invention with the case shown in closed position and housing the camera in closed and collapsed condition, with a cover flap of the case unfastened and folded out of the way to disclose an opening in the top sections of the case which accommodates the viewfinder of the camera and permits access thereto for erecting the camera and case to their operative positions.
Figure 3:
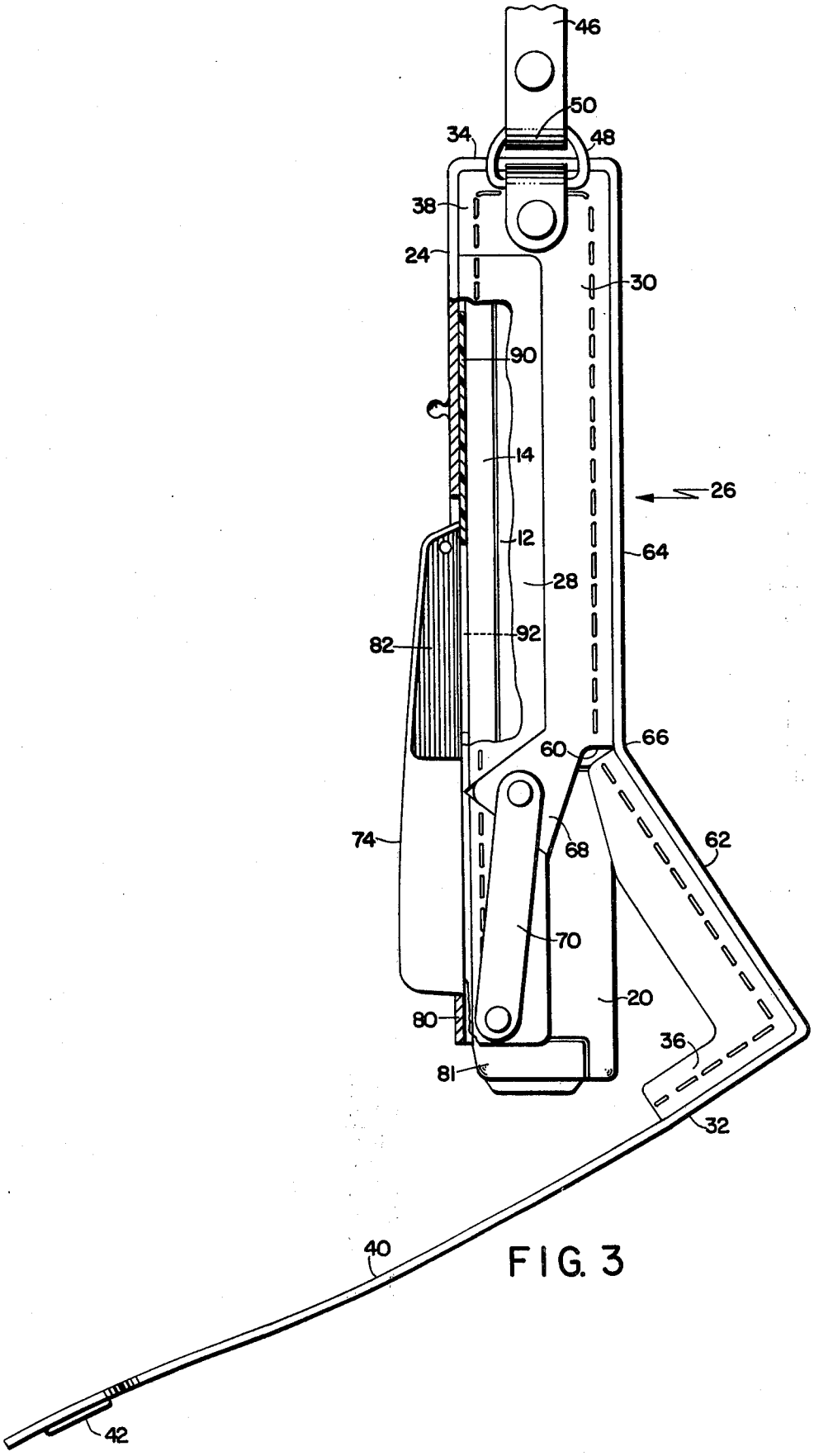
FIG. 3 is a side elevational view, partly in section, of the instant invention as it would appear if hung from the neck of a user with the cover flap shown in an unlatched position.

The carrying case of the present invention is generally designated 10 in the drawings where it is shown in its preferred embodiment as providing a novel construction for housing and carrying of a camera of the general type disclosed in U.S. Pat. No. 3,810,211 which includes a plurality of housing sections 12, 14, 16 and 18 pivotally coupled to one another for relative movement between a compact folded or collapsed inoperative position, as shown in FIGS. 2 and 3, and an extended or erected operative position, as shown in FIG. 1 wherein sections 12 and 16 define an acute angle therebetween. Extending forwardly of housing section 12 is a spread roller housing 20. Housing 20 is pivotally coupled to an inner frame of the camera at hinge 22 for pivotal movement in a counterclockwise manner to a position wherein a film cassette may be inserted into a cassette receiving chamber located within housing section 12, as is well known in the art.

The case 10 may be made of various materials customarily used in the art of camera carrying cases, such as natural leather, artificial leather, and even plastic material, all of which are particularly well suited to carry out the intended function of the case. Case 10, preferably formed of leather, comprises a top portion 22 which is integrally hinged at 24 to a bottom portion 26 at the right hand side of the case, as viewed in the drawings. Both top and bottom portions 22 and 26 of the case are provided with relatively rigid side walls 28 and 30 which are secured by stitching, or the like, to the flexible leather portions of the top and bottom portions, with the edges of side walls 28 of the top portion adapted to abut the edges of side walls 30 of the bottom portion 26 when the case is closed, as seen in FIG. 2. Additionally, the bottom portion 26 of the case is provided with upstanding end walls 32 at the front end of the case and 34 at the rear of the case, which are rigidly supported in position by upstanding rigid portions 36 and 38 of the side walls on each side of the case, said rigid portions 36 and 38 extending upwardly about twice the height of the side walls 30 of the bottom portion to thereby abut the ends of side walls 28 and provide end walls that completely close off both ends of the case when the top portion 22 is in the position shown in FIG. 2.

At the front end of the case, a flexible cover flap 40 is provided which forms an integral extension of the upper portion of the end wall 32 and is adapted to cover a major portion of the top portion 22 of the case and be securely held in place by suitable means, such as snap fastener elements 42 and 44 carried by the flap and top portion, respectively.

An adjustable neck strap 46 is secured to the rear end of the case with each end of the strap being secured to a ring 48 securely held by a strap loop 50 riveted or otherwise fastened to the side wall portions 38.

In the preferred form of the invention as shown, the flap 40, the end walls 32 and 34 and the top and bottom wall portions 22 and 26 are formed of a flexible leather and preferably this may be a single, integral piece of flexible leather. This is important since as will be explained hereinafter, wherever the rigid side wall support for the top or bottom portions is omitted or cut-away, on both sides of the case, a flexible integral hinge connection is formed and these hinges become very important in the specific functioning of the carrying case.

Both the top and bottom portions 22 and 26 have cut-out sections in their respective rigid side walls 28 and 30 on each side of the case to divide each portion into hinged sections. For example, the side walls 28 of top portion 22 are cut-away at 52 to form a hinged connection at 54 between forward and rear sections 56 and 58 of the top portion 22 so that the sections 56 and 58 may move from the common plane which they occupy in the folded position to the position shown in FIG. 1 to accommodate housing sections 14 and 16 of the erected camera.

The side walls 30 of the bottom portion 26 are cut-away at 60 to divide this portion into forward and rear sections 62 and 64 connected by an integral flexible hinge 66. This will permit the section 62 of the bottom portion 26 carrying end wall 32 and cover flap 40 to swing downwardly about the hinge 66 to open up the front end of the case for the removal and insertion of film cassettes into housing section 12.

Additionally, forward each of the side walls 30 at the end of section 64 in the vicinity of the cut-out 60 are provided with upstanding ears or flanges 68 to which the pivotally mounted one end of links 70, the other end of said links being pivotally mounted on the side walls 28 of top section 56 near the forward end thereof.

By virtue of the particular construction and arrangement of elements, the parts of the carrying case may be completely collapsed to the position shown in FIG. 2 with the sectional top and bottom case portions 22 and 26 completely encasing the collapsed camera and with the links 70 so positioned as to permit this movement with the links 70 nearly parallel to the case body.

In effect the case comprises a four section enclosure for the camera embodying the two upper sections 56 and 58 and the two lower sections 62 and 64. Additionally, the case defines a four bar linkage consisting of the side walls 28 of sections 56 and 58, the side walls 30 of section 64 and the links 70. This four bar linkage prevents the camera from falling out of the case when the sections of the case are in the positions shown in FIG. 1 and the camera is hanging from the user's neck.

The top portion 22 is also provided with a relatively large cut-out portion 72 extending from the forward portion of section 56, which lies close to the end wall 32 when the case is closed, across the hinge 54 and well into section 58. This cut-out portion is generally rectangular in configuration and of sufficient size and dimensions to accommodate an extension of housing section 16, namely, the outer cover or cap 74 of the viewfinder of the self-developing camera, which cap protrudes through the opening. Cut-out portion 72 is preferably provided with a pair of outwardly extending recesses 76 and 78 which facilitate the grasping of cap 74 at portions 82 prior to erecting the camera and case 10.

The camera in folded and collapsed form is readily inserted through the front end of the case. The flap 40 is then pulled over the top and fastened in position. The flap is of sufficient length and width to fully cover and protect the viewfinder cap 74. The case and camera may then be carried by the neck strap in an inoperative and collapsed condition.

When the camera is to be used and while the case and camera are still supported by the neck strap, the flap 40 is unfastened and allowed to hang down from the front end of the case. The front end wall 32 at this point will still snugly fit the camera and together with a section 80 of portion 56 which engages the left end of the cap 74 will prevent the camera from sliding forward and falling out of the case. The cap 74 of the viewfinder which protrudes through the rectangular opening 72 is then grasped at each side at 82 and pulled upwardly and to the rear while the camera and case is firmly held with the other hand. This movement of the viewfinder will erect the camera to its operative position and the upper portions 56 and 58 of the case will follow the camera's movement until the parts reach the position shown in FIG. 1. In this opened position, the camera is securely held by the parts of the case and the same may still be safely hung from the neck.

When the camera is erected and the parts of the case moved to the position of FIG. 1, the front end section 62 of the bottom portion of the case will be allowed to pivot downwardly about the hinge 66 which will permit the user to have access to the spread roller housing 20 which is pivotally connected to the front end of the camera about hinge 22. The integral hinge 66 between the bottom sections 62 and 64 is located at a point approximately ¼ inch to the right of the hinge 22 of the roller housing 20, so as to permit the roller housing 20 to be pivoted downwardly through approximately a 90° angle in a counterclockwise direction, as viewed in FIG. 1, to enable a film cassette to be inserted into or removed from the main housing section 12 of the camera. If the hinge 66 is too close to the pivot point 22, or forward of it, the user will not be able to pivot the spread roller housing 20 properly to remove or insert film cassettes. Furthermore, if the hinge 66 is spaced too far to the right of pivot point 22, the center of gravity of the camera may be forward or to the left of the point at which the user's hand grasps bottom section 64, thereby making it uncomfortable for the user to handle.

Furthermore, the hinge 54 between top sections 56 and 58 and the links 70 should be so designed and placed as to accommodate the pivoted parts of the camera body, including the erected bellows section 84 and the camera lens front included in housing section 18.

After one or more scenes have been photographed, the camera and carrying case 10 may be moved into their collapsed positions and carried by the strip 46 in a vertical orientation, as shown in FIG. 3. It will be noted that in this orientation closure flap 40 is not secured and lower section 62 and end wall 32 are spaced from the camera thereby leaving section 80, which extends across the front of the viewfinder cap 74, as the main supporting member for preventing the camera from falling out of the carrying case. Should the sections of the carrying case move toward their erected positions while the camera is still in a folded condition, section 80 may move to a position wherein it is out of supporting relationship with the leading end of cap 74 in which case the camera will drop out of the carrying case. In order to preclude the foregoing, a U-shaped rigid plate-like member 90 is secured by any suitable means, e.g., an adhesive and/or stitching, to the inner surface of section 58. Plate 90 includes a pair of legs 92 and 94, the inwardly facing edges of which are adapted to slide under and engage the downwardly facing edges of sections 82 of cap 74 during insertion of the camera into the carrying case 10. The engagement between plate 90 and sections 82 of cap 74 prevents relative movement between sections 56 and 58 of the carrying case when the camera stays in its folded position. Stated another way, relative movement between sections 56 and 58 is possible only when housing section 16 and its viewfinder and cap 74 move toward the extended position. Referring back to FIG. 3, it can be seen that if the sections of the carrying case inadvertently moved to the extended position, plate 90 would simultaneously apply an erecting force to cap 74 thereby moving the sections of the camera toward the extended position. As the sections of the camera and the carrying case simultaneously move out of the collapsed position, section 80 will move with the leading edge of the cap 74 thereby maintaining its supporting relationship therewith. Although a plate-like member 90 has been described as the preferred means for preventing premature erection of the carrying case when the camera is still in a folded condition, it should be understood that the instant invention is not limited thereto. For example, it is within the scope of the invention to provide the flanges 28 of section 58 with means, e.g., clips that would engage the lateral downwardly flanges of housing section 14 thereby insuring simultaneous movement of sections 58 and 14.

Since certain changes may be made in the above-described carrying case without departing from the scope of the invention herein involved, it is intended that all matter contained in the above description, or shown in the accompanying drawings, shall be interpreted as illustrative and not in a limiting sense.

What is claimed is:

1. A carrying case for use with a camera of the type including first and second housing sections mounted for movement between a compact, inoperative position and an erected, operative position, said carrying case comprising:

first and second sections transversely hinged to each other for movement with the first and second housing sections between the inoperative and operative positions; and means on one of said first and second sections of said carrying case for engagement with one of the first and second housing sections for preventing movement of said first and second sections toward the operative position when the first and second housing sections are in the inoperative position.

2. A carrying case as defined in claim 1 wherein said engagement means extends from said second section into engagement with the first housing section when said first and second sections are in said inoperative position.

3. A carrying case as defined in claim 2 wherein said engagement means comprises a rigid plate-like member secured to said second section.

4. A carrying case as defined in claim 2 wherein said first and second sections are located in a common plane when in the inoperative position and define an oblique angle therebetween when in said operative position.

5. A carrying case of the ever-ready type for a photographic camera of the compact collapsible type which is extendible and erectible from a folded inoperative position to a fully operative position in use, said carrying case comprising:

a top portion and a bottom portion transversely hinged to each other near a rear end of said case, said top portion including a transverse hinge dividing said top portion into forward and rear sections and said bottom portion including a transverse hinge dividing said bottom portion into forward and rear sections;

means connecting a forward end of said forward section of said top portion to a forward end of said rear section of said bottom portion, said top portion being movable from a closed position with respect to said bottom portion to an erected position on erection of the camera to its operative position, with said forward and rear sections of said top portion assuming an inverted V-shape configuration which snugly fits and retains erected parts of the camera and with said connecting means adequately spacing said forward end of said forward top section from said lower rear section; and means mounted on said rear section of said top portion for engagement with the camera to prevent movement of said top section into said erected position when the camera is in the inoperative position.

6. A carrying case as defined in claim 5 wherein said engagement means comprises a plate-like member secured to said rear section of said top portion.

7. Photographic apparatus comprising, in combination:

a photographic camera including first, second and third housing sections mounted for movement between a folded inoperative position wherein surfaces of said second and third housing sections are located in a common plane and an erected operative position wherein said surfaces of said second and third housing sections define an oblique angle therebetween; and a carrying case including a first section adapted to receive said first housing sections; a second section including a first portion adapted to overlie said third housing section and a second portion adapted to overlie said second housing section when said camera is in said folded and erected positions; means coupling said first and second sections for movement with said first, second and third housing sections between said folded and erected positions; and means on said second section for engagement with one of said first, second and third housing sections for preventing movement of said first and second portions toward said extended position when said second and third housing sections are in said folded position.

8. A combination as defined in claim 7 wherein said engagement means engages said third housing section.

9. A combination as defined in claim 8 wherein said engagement means is located on said second portion and said third housing section includes means extending from said surface of said third housing section across said engagement means when said camera is in said folded position.

10. A combination as defined in claim 9 wherein said extending means is a viewfinder.

* * * * *